US008381494B2

(12) United States Patent
Krakers

(10) Patent No.: US 8,381,494 B2
(45) Date of Patent: Feb. 26, 2013

(54) METHOD FOR CONTROLLING THE OPERATION OF AN ASEPTIC FILLING MACHINE

(75) Inventor: Bernardus Antonius Johannes Krakers, Uitgeest (NL)

(73) Assignee: Stork Food & Dairy Systems B.V., Amsterdam (NL)

( * ) Notice: Subject to any disclaimer, the term of this patent is extended or adjusted under 35 U.S.C. 154(b) by 327 days.

(21) Appl. No.: 12/692,855

(22) Filed: Jan. 25, 2010

(65) Prior Publication Data

US 2011/0180179 A1 Jul. 28, 2011

(51) Int. Cl.

| | |
|---|---|
| ***B65B 55/04*** | (2006.01) |
| ***B65B 57/00*** | (2006.01) |
| ***B65B 7/28*** | (2006.01) |

(52) U.S. Cl. ..... 53/426; 53/471; 53/52; 53/77; 53/167; 53/281

(58) Field of Classification Search ..... 53/167, 53/281, 282, 426, 471, 52, 77; 422/3, 26, 422/28, 34, 36; *B65B 55/04, 57/00*
See application file for complete search history.

(56) References Cited

U.S. PATENT DOCUMENTS

| | | | | |
|---|---|---|---|---|
| 4,172,347 | A * | 10/1979 | Nitz | 53/52 |
| 5,488,811 | A * | 2/1996 | Wang et al. | 53/52 |
| 5,788,925 | A * | 8/1998 | Pai et al. | 422/3 |
| 7,491,371 | B2 * | 2/2009 | Moller et al. | 422/292 |
| 2005/0097863 | A1 * | 5/2005 | Taggart | 53/167 |
| 2007/0162287 | A1 * | 7/2007 | Dietzsch et al. | 705/1 |
| 2010/0043915 | A1 * | 2/2010 | Sangi et al. | 141/11 |
| 2010/0287879 | A1 * | 11/2010 | Donati et al. | 53/52 |

FOREIGN PATENT DOCUMENTS

| | | | |
|---|---|---|---|
| EP | 0180540 | | 5/1986 |
| EP | 534777 | A2 * | 3/1993 |
| WO | 2007102765 | | 9/2007 |
| WO | 2009083594 | | 7/2009 |
| WO | 2009083595 | | 7/2009 |
| WO | 2009083597 | | 7/2009 |
| WO | 2009083598 | | 7/2009 |

* cited by examiner

*Primary Examiner* — Stephen F Gerrity
(74) *Attorney, Agent, or Firm* — Hoffmann & Baron, LLP

(57) ABSTRACT

A method for controlling the operation of an aseptic product filling machine includes the steps of performing a pre-production test procedure during a pre-production phase in which at least a set of subcritical control parameters are measured, diagnosed and stored, checking if those subcritical control parameters are within their range, starting a production phase if all of the subcritical control parameters are indeed within their range, and measuring, diagnosing and storing a set of supercritical control parameters and not the subcritical control parameters during the production phase.

11 Claims, 2 Drawing Sheets

METHOD FOR CONTROLLING THE OPERATION OF AN ASEPTIC FILLING MACHINE

FIELD OF THE INVENTION

The invention relates to a method for controlling the operation of an aseptic filling machine, and to an aseptic filling machine comprising a control unit for performing such a method.

BACKGROUND

In an aseptic filling machine holders, like glass or plastic bottles, carbon packages, or the like, can be sterilized and subsequently filled with a product, in particular a food product, under sterile conditions. After being filled with the product, the holders can be hermetically closed under these same sterile conditions with a sealing element, like a screw cap, foil lid, or the like. These actions of sterilizing, filling and closing of the holders take place at sterilization, filling and closing stations. Before starting with an actual production phase during which the holders are sterilized, filled and closed, firstly the stations are sterilized in a pre-production phase. The stations are placed in a machine base frame in which an aseptic zone is defined. The aseptic zone is also sterilised prior to starting the actual production.

The proper aseptic operation of such an aseptic filling machine is monitored on the basis of a number of defined critical control parameters, so-called CCP's. As soon as one of these CCP's gets outside a pre-defined range, the production phase or the pre-production sterilization phase, is immediately stopped. Only after it has been detected what went wrong, and, if necessary, after maintenance has been performed, the production phase can be re-started again. Before re-starting the production process, it is however necessary to first sterilize the stations themselves, and the aseptic zone, again. In presently known aseptic filling machines, the CCP's are monitored continuously. Not only during the actual production phase, but also during the pre-production phase of sterilization of the stations and of the aseptic zone, and sometimes even during stand-still of the machine. With this all the measured data for the CCP's are saved on a legal data recorder, so that the data can be used as evidence for governmental health department rules.

A disadvantage of this is that the total number of CCP's can be enormous. In fact since during the last years the design of the aseptic filling machines gets more and more complex, the total number of CCP's increases rapidly. At this moment there are aseptic filling machines known in which 1000-1500 CCP's are defined, all of which need to be monitored continuously. This permanent monitoring of such a large number of CCP's is very complex and expensive, particularly when they all need to be saved on a legal data recorder. Furthermore it is disadvantageous that the larger the number of CCP's, the more complex, expensive and less reliable the aseptic filling machine becomes.

SUMMARY OF THE INVENTION

The present invention aims to at least partly overcome the above-mentioned disadvantages, or to provide a usable alternative. In particular it aims to provide a more efficient and still reliable method for controlling the operation and aseptic integrity of an aseptic filling machine.

This aim is achieved by a novel and inventive method for the controlling of the proper functioning of an aseptic filling machine.

The operation of the aseptic filling machine which this method is to control comprises a pre-production phase during which at least sterilization, filling and closing stations of the machine and possibly also an aseptic zone of the machine are sterilized and during which possibly some test runs are performed, and a production phase during which sterilization, filling and closing of a certain batch of holders takes place at the respective stations. During the operation, control parameters of the stations are monitored for remaining within a pre-defined range. This monitoring comprises a measuring of the control parameters by means of sensors, a diagnosing of these measured control parameters, manual or by a control unit and a storing of these measured control parameters, for example at an electronic data storage medium.

According to the invention each of the control parameters has been classified into a category of supercritical and a category of subcritical control parameters. This classification is necessary as input for the method according to the invention. This method firstly comprises a step of performing a pre-production test procedure during the abovementioned pre-production phase. In this pre-production test at least the subcritical control parameters, and possibly also the supercritical control parameters, are measured, diagnosed and stored. Secondly at least the subcritical control parameters, and possibly also the supercritical control parameters, are checked if they lie within their range. Only if the outcome of this check is positive, that is to say if at least all of the subcritical control parameters, and possibly also of the supercritical control parameters, are indeed within their range, the actual production phase is started. During the production phase only the supercritical control parameters are measured, diagnosed and stored and not the subcritical control parameters. This has the great advantage that only a limited number of control parameters need to be monitored permanently during this production phase. A saving of 80-95% is foreseen in the number of critical control parameters which need to be monitored during the production phase itself. For example for an aseptic filling machine which has 1000 CCP's, a saving of 800-950 sub-CCP's can be achieved which no longer need to be monitored permanently. For those sub-CCP's a monitoring during the pre-production test suffices. This makes the machine, and in particular the control unit thereof, less complex, cheaper and more reliable. Also the storing of the measured data for the various CCP's needs considerably less memory space, which limits the number of legal data recorders.

The classification of the control parameters in either the subcritical or supercritical category can be done on the basis of a risk analysis. This classification determines whether a specific control parameter needs to be monitored permanently during the production phase or can be checked incidentally during a pre-production test. In this risk analysis there can for example be looked at the likelihood and the effect of a deviation of a specific control parameter. Also it is possible to look at the conditions under which that specific control parameter needs to be registered, the chance of failure of the sensor for measuring that control parameter, and/or the impact of this sensor having a deviation in its measuring performance.

The pre-production test procedure checks at least the subcritical control parameters and if deemed necessary also the supercritical ones. The result of this test is a go-no go decision for starting up the production phase. This decision can also be stored on the electronic data storage medium as evidence material, for example for FDA requirements. The test is structured in that there is a certain sequence and timing during the pre-production phase for the CCP's to be monitored. The test may also comprise a number of manual verifications, the results of which can be inputted manually in the control system of the machine, where they can be checked automatically for maintaining within their pre-defined range.

In a preferred embodiment the inventive idea is incorporated in the monitoring of the proper functioning of so-called split lines, that is to say main medium feed lines which split up into a number of branch medium feed lines. A number of such split lines are present in most aseptic filling machines. With this a main sensor is provided for measuring a control parameter at the main medium feed line and branch sensors are provided for measuring a similar type of control parameter at their corresponding branch medium feed lines. The control parameter to be measured by the main sensor can then advantageously be classified as being a supercritical control parameter and the control parameters to be measured by the branch sensors as being subcritical control parameters. The pre-production test procedure can then advantageously monitor the sensors of at least the branch lines, and possibly also of the common main line, whereas during the production phase only the single one sensor of the main line needs to be monitored.

A lot of aseptic filling machines are known to have their stations comprise a plurality of holder positions after and/or next to each other for sterilizing, filling and/or closing a plurality of holders at the respective stations at the same time. The main medium feed lines can then be connected to central medium supplies, and from there each split up into a plurality of branch feed lines which each lead to a distribution nozzle at one of the plurality of holder positions. If for example the machine comprises 12-18 rows of holder positions next to one another, it is known to have x times those 12-18 branch lines which are each provided with a sensor for measuring a control parameter. The branch sensors of at least some of the split lines can then advantageously be classified in the subcritical category. This saves up 12-18 CCP's per certain type of split line which no longer need to be monitored during the operation phase. For rotary filling machine the advantage can even be more. Carrousels with more than 100 stations are commonly used to sterilize, fill and seal bottles. Since each of the sterilization, filling and closing stations is likely to be provided with one or more distribution nozzles of corresponding split lines at each of its holder positions, one can imagine the major saving which can be achieved according to the invention.

One of the split lines may for example be a sterilization medium feed line, like hydrogen peroxide, which is destined to distribute sterilization medium to individual holder positions at the sterilization station for sterilizing the insides of the holders, or to individual holder positions at the closing station for sterilizing the closing elements shortly before they are put on the holders. In addition or as an alternative, one of the split lines may also be a drying gas feed line which leads to individual injection nozzles at holder positions of the sterilization station. Also it is possible to use the inventive thought for a purge feed line which is destined to distribute a purge medium to individual holder positions at the closing station. Purge medium, for example nitrogen gas, can be injected in the upper part of a holder shortly after it has been filled with product to remove any oxygen form this upper part of the holder just before it is closed.

Depending on the construction of the machine it may be necessary to perform part of the pre-production test procedure before or during the sterilization of the stations. Preferably however at least part of the pre-production test procedure is performed after the sterilization of the stations has been completed. This has the advantage that the test also says something about the degree of machine sterilization itself.

It is known to perform a number of subsequent pre-production and production phases after each other. From time to time the stations need to be sterilized before continuing with the actual production. According to an aspect of the invention in that case, it is possible to each time perform a pre-production test procedure in between two production phases. The method can then incorporate an evaluation step in which sterilized, filled and closed holders of a particular production phase are only released for distribution after the pre-production test procedure which is performed after this particular production phase has a positive outcome. Together with the pre-production test procedure which was performed before the starting of this particular production phase and together with the monitoring of the supercritical control parameters during this particular production phase, this further enlarges the reliability of the control method according to the invention.

Further advantageous embodiments of the method according to the invention are stated in the dependant subclaims.

The invention also relates to an aseptic filling machine itself comprising a sterilization, filling and closing station, and a control unit which is designed for performing the above described method.

BRIEF DESCRIPTION OF THE DRAWINGS

The invention shall be dealt with in further detail below with reference to the accompanying drawings, wherein.

DETAILED DESCRIPTION OF THE PREFERRED EMBODIMENTS

Figure 1:
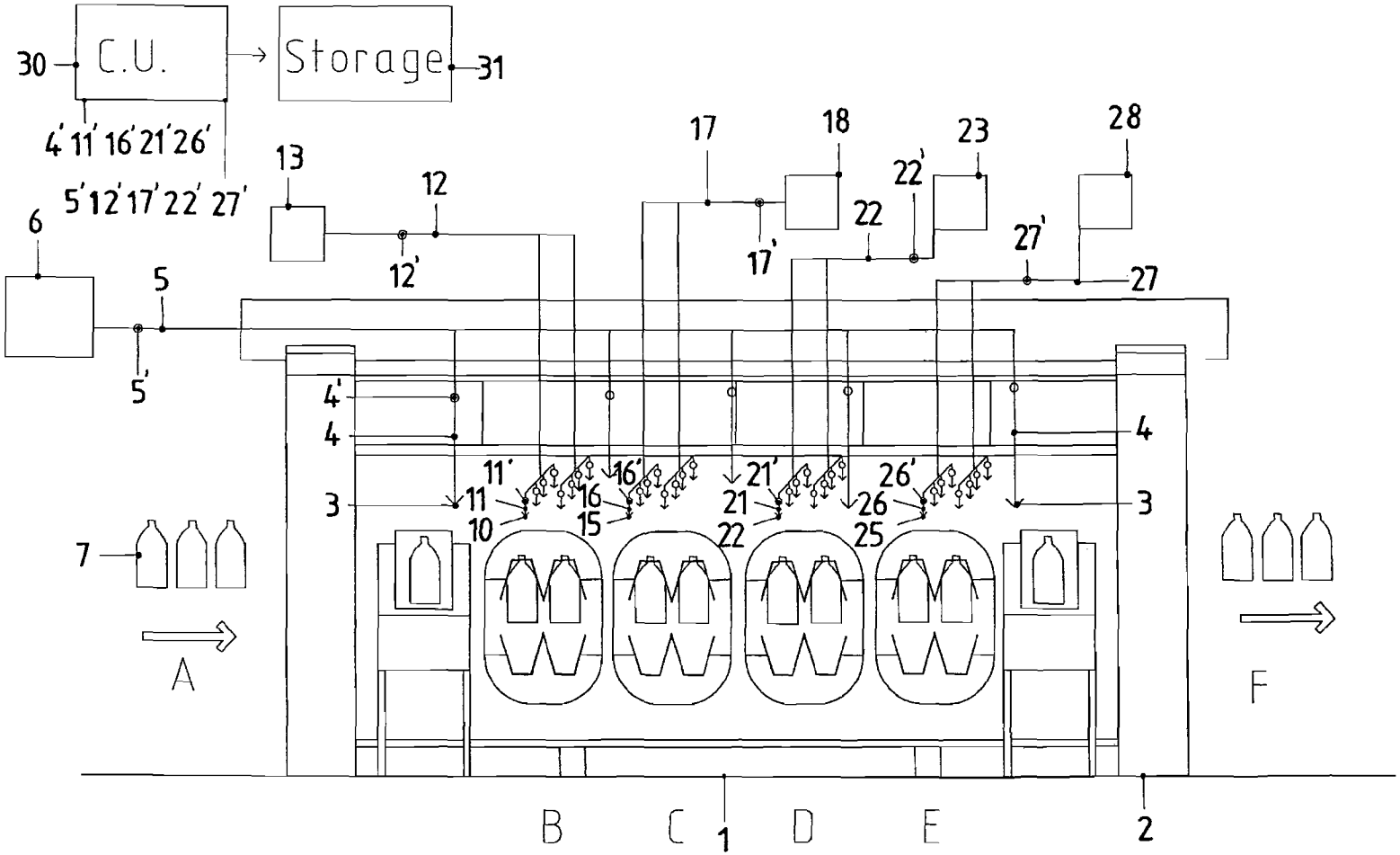
FIG. 1 shows a schematic longitudinal section of an aseptic product filling machine according to the invention.

In FIG. 1 an aseptic product filling machine in its entirety has been indicated with the reference numeral 1. The machine 1 comprises a base frame 2 with an aseptic zone. The aseptic zone is provided with a plurality of distribution nozzles 3 for distributing a sterilization medium, like sterile gas or air, inside the aseptic zone. The nozzles 3 are each provided at the ends of branch lines 4. The branch lines 4 are in flow communication with a common main line 5 which in turn is connected to a central sterilization medium supply 6.

During a production phase, empty bottles 7 are fed to one side A of the machine 1 and there enter the aseptic zone, where they first arrive at a sterilization station B. The sterilization station B is provided with a plurality of distribution nozzles 10 for injecting a sterilization medium, like peroxide vapour, into the bottles 7. The nozzles 10 are each provided at the ends of branch lines 11. The branch lines 11 are connected to a main line 12 which in turn is connected to a central sterilization medium supply 13. The station B has a plurality, in this case eight, nozzles 10 and branch lines 11. During the production phase each time a corresponding number of bottles 7 can be intermittently positioned underneath the nozzles 10 by means of a suitable transportation system.

From the sterilization station B the sterilized bottles 7 enter a drying station C. The drying station C is likewise provided with a plurality of distribution nozzles 15, in this case for injecting a drying medium, like a hot drying gas or air, into the bottles 7. The station C likewise comprises a plurality of holder positions next to and after each other. The nozzles 15 are each provided at the ends of respective branch lines 16. The branch lines 16 are connected to a main line 17 which in turn is connected to a central drying medium supply 18.

From the drying station C the sterilized dried bottles 7 enter a filling station D. The filling station D is provided with a plurality of distribution nozzles 20, in this case for injecting a product, in particular a liquid foodstuff, into the bottles 7. The station D again comprises a plurality of holder positions next to and after each other. The nozzles 20 for each of the holder positions are provided at the ends of branch lines 21 which in turn are connected to a main line 22 which connects to a central product supply 23.

From the filling station D the filled bottles 7 enter a closing station E. The closing station C may likewise be provided with a plurality of distribution nozzles 25, in this case for injecting a purge medium, like nitrogen gas, into the upper part of the bottles 7 which upper part has remained unfilled with product at the preceding filling station D. The station E also comprises a plurality of holder positions next to and after each other. The nozzles 25 are provided at the ends of branch lines 26 which via a common main line 27 connect to a central purge medium supply 28. Furthermore the closing station E comprises closing means for placing lids, caps, foils or the like on top of filled and purged bottles 7.

Finally the filled and closed bottles 7 leave the aseptic zone of the machine 1 at the side F.

Each of the above described main lines 5, 12, 17, 22, 27 is provided with a main sensor 5', 12', 17', 22', 27'. Further each of the above described branch lines 4, 11, 16, 21, 26 is provided with a branch sensor 4', 11', 16', 21', 26'. Each of the main and branch line sensors is designed to measure a specific control parameter of a medium flowing through its corresponding main or branch line. For example the sensor may be a pressure sensor, temperature sensor, flow meter or flow switch for measuring a pressure, temperature or flow of the medium flowing through the line. The measured pressures, temperatures and flows are used as control parameters which together are indicative for a proper functioning of the various flows through the various main and branch lines and out of the various nozzles during pre-production sterilization and normal operation of the machine 1.

The measured control parameters are diagnosed with the aid of a control unit 30 for lying within certain pre-defined ranges. Furthermore the measured control parameters are stored as evidence material at an electronic data storage medium 31.

According to the invention the operation of the machine 1 is controlled by a certain selective procedure of monitoring and diagnosing of the control parameters. For this the control parameters measured by the main sensors 5', 12', 17', 22' and 27' are classified as so-called supercritical control parameters, whereas the control parameters measured by the branch sensors 4', 11', 16', 21' and 26' are classified as subcritical control parameters.

Figure 2:
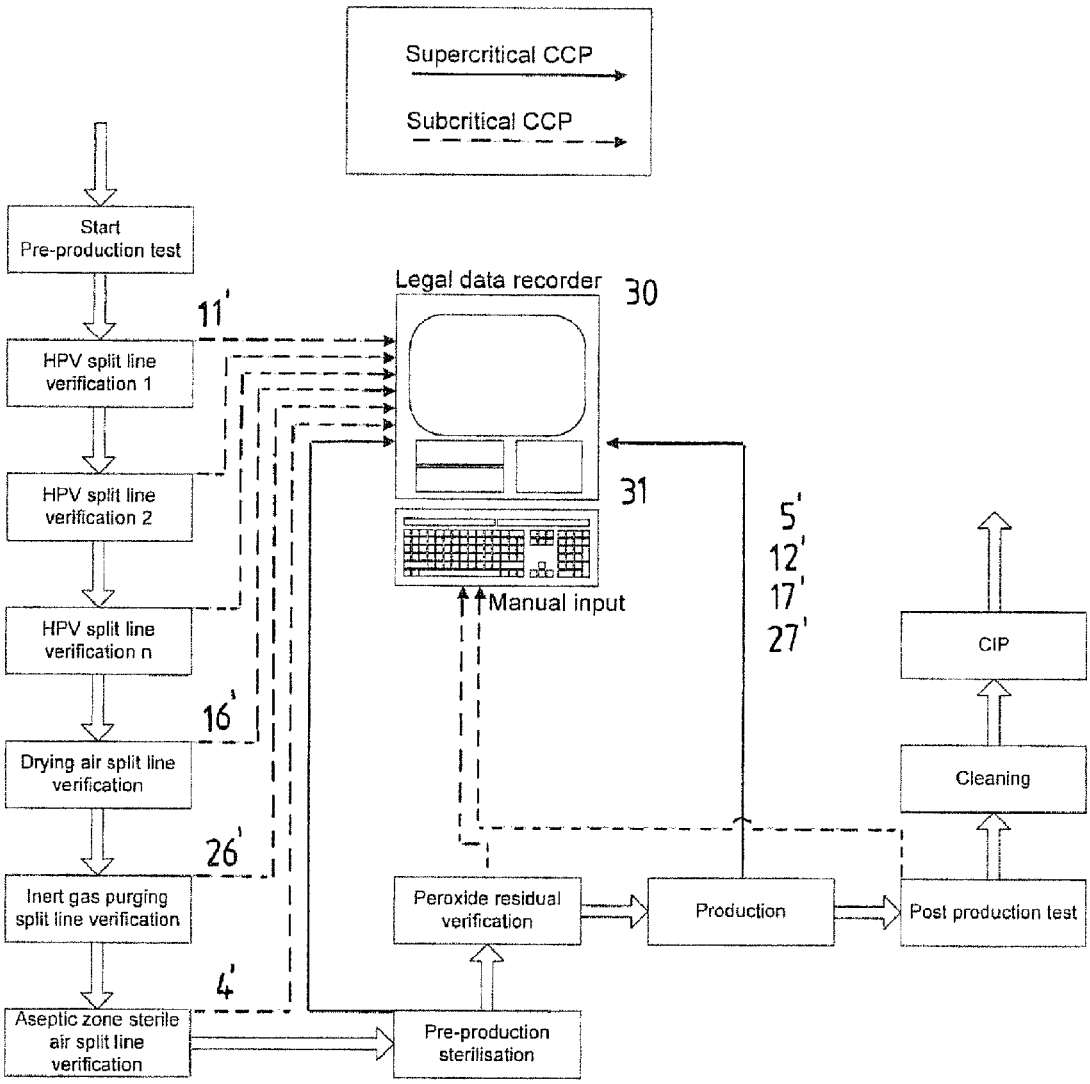
FIG. 2 shows a schematic overview of the various steps of a preferred embodiment of a method for controlling the operation of the machine of FIG. 1.

Before starting a production phase at the machine 1, first of all a pre-production phase is run. This pre-production phase includes a pre-production test procedure in order to check if all elements of the machine 1 are functioning as they are supposed to be. Furthermore this pre-production phase comprises a pre-production sterilization of the aseptic zone and of the various stations of the machine 1 in order to make the machine 1 sterile and thus ready for production. See FIG. 2.

During this pre-production test the subcritical control parameters of the branch lines 4, 11, 16, 21 and 26 are measured in a certain order by their sensors 4', 11', 16', 21' and 26', inputted into and diagnosed by the control unit 30, and stored at the storage medium 31. For being able to get measurement results, the lines are temporarily fed with a medium. For some of the lines this medium to be fed during testing may not be the same as the medium which flows through the lines during the actual production phase. For example the lines 21 and 22 can not be fed with the actual product during this pre-production test, because this would immediately contaminate the entire filling station. Instead they can for example temporarily be fed with a sterilization medium.

The control unit 30 checks if the measured subcritical control parameters are within their pre-defined range. If the subcritical control parameters are indeed within their range, the pre-production sterilization is started. If some of the subcritical control parameters are not within their predefined range, then maintenance is performed to the possibly blocked lines and/or nozzles, because otherwise the pre-production sterilisation can not be performed properly. After the pre-production sterilisation has been completed, again some control parameters are measured, diagnosed and stored. Also a test series can be run in which a limited number of bottles 7 is sterilized, dried, filled, purged and/or closed at the respective stations B-E. Those bottles 7 can then be tested, which test results can be inputted in the control unit 30. If those measured control parameters and/or test results are also positive, that is to say lie within their predefined ranges, the actual production phase is started.

According to the inventive thought during this actual production phase use is being made of the distinctive categories of supercritical and subcritical control parameters. Only the supercritical control parameters are now measured, diagnosed and stored during the production phase. The subcritical control parameters are not measured, diagnosed and stored during this production phase. This saves a lot of memory space, makes the control of the machine during production easier and less complex. It even has appeared that it makes the machine more efficient and cheaper in operation, since false alarms of defective sensors which otherwise would immediately stop the machine are far less likely to occur. By at least testing the main sensors for a normal flow of medium through the main lines it has appeared that it can be safely assumed that the branch lines and nozzles are functioning properly. Should one of the branch lines or nozzles get blocked during the production phase, this is likely to be immediately measured by one of the supercritical control parameters as measured by the main sensors getting outside its pre-defined range.

After the production phase has been completed, a post-production test is performed. If this post-production test has a negative outcome, this immediately leads to the decision that the filled bottles can be given free for commercial distribution, but that instead they need to be destroyed. Thus, in the unlikely case that a blocking of one of the branch lines or nozzles should not be detected by one of the supercritical control parameters getting outside its range during a production phase, this blocking can at least be detected during the subsequent post-production test, for example by having this post-production test measuring, diagnosing and storing the subcritical control parameters of the branch sensors 4', 11', 16', 21' and 26' again. If the post-production test has a positive outcome, it is followed by a cleaning of the machine, after which the machine is ready for another cycle.

Besides the embodiment shown numerous variants are possible. For example it is possible to also use the invention for other types of split lines present in the machine which also have a main line with a main sensor which splits up into a plurality of branch lines with a plurality of branch sensors. Also the inventive method can advantageously be used for various other control parameters of the machine which can be classified as subcritical, and thus only need to be monitored during a pre-production phase and not during the production phase. Instead of only monitoring the subcritical control parameters during the pre-production test it is also possible to have the pre-production test include a monitoring of the supercritical control parameters. This makes the pre-production test even more reliable. Also this makes it possible to compare measurement results of those supercritical control parameters during the pre-production phase and the production phase with each other. The invention can be used for all types of aseptic filling machines, both of the linear and rotary type, and both of the intermittent and continuous type. The sensors can be connected to the control unit and storage medium by means of wiring or wireless. It is also possible that some of the sensors have their measurements manually inputted to the control unit and/or storage medium. The post-production test and cleaning can advantageously be partly combined with a pre-production test and pre-production sterilization of a new production cycle.

Thus, an efficient and reliable method and machine are provided for controlling the proper functioning of an aseptic product filling machine. The method helps in keeping the control method practicable even if the machine itself gets more and more complex and gets equipped with more and more sensors.

The invention claimed is:

1. Method of operation of an aseptic product filling machine, the operation comprising:

a pre-production phase in which sterilization, filling and closing stations of the machine are sterilized, and a production phase in which a sterilization, filling and closing of a plurality of holders takes place at the respective stations, in which, during the operation, control parameters of the stations are monitored for remaining in a pre-defined range, in which the monitoring comprises a measuring of the control parameters by means of sensors, a diagnosing of the measured control parameters and a storing of the measured control parameters, and in which the control parameters have been classified into a category of supercritical and a category of subcritical control parameters, wherein the method further comprises the steps of:

performing a pre-production test procedure during the pre-production phase in which at least the subcritical control parameters are measured, diagnosed and stored;

checking if the subcritical control parameters are within their range;

starting the production phase if all of the subcritical control parameters are indeed within their range; and measuring, diagnosing and storing the supercritical control parameters and not measuring, diagnosing and storing the subcritical control parameters during the production phase.

2. Method according to claim 1, wherein at least part of the pre-production test procedure is performed after the sterilization of the stations has been completed.

3. Method according to claim 1, wherein at least some of the sensors for measuring the control parameters are pressure sensors, flow meters or flow switches.

4. Method according to claim 1, wherein during the pre-production phase both the supercritical and subcritical control parameters are measured, diagnosed and stored, after which both the supercritical and subcritical control parameters are checked for being within their range, and the production phase is started if both the supercritical and subcritical control parameters are indeed within their range.

5. Aseptic filling machine comprising:

a sterilization station for sterilizing holders with a sterilization medium and drying the sterilized holders with a drying gas;

a filling station for filling the sterilized dried holders with a product;

a closing station for closing the filled holders with a sealing element; and a control unit for performing the method of claim 1.

6. Method of operation of an aseptic product filling machine, the operation comprising:

a pre-production phase in which sterilization, filling and closing stations of the machine are sterilized, and a production phase in which a sterilization, filling and closing of a plurality of holders takes place at the respective stations, in which, during the operation, control parameters of the stations are monitored for remaining in a pre-defined range, in which the monitoring comprises a measuring of the control parameters by means of sensors, a diagnosing of the measured control parameters and a storing of the measured control parameters, and in which the control parameters have been classified into a category of supercritical and a category of subcritical control parameters, wherein the method further comprises the steps of:

performing a pre-production test procedure during the pre-production phase in which at least the subcritical control parameters are measured, diagnosed and stored;

checking if the subcritical control parameters are within their range;

starting the production phase if all of the subcritical control parameters are indeed within their range; and measuring, diagnosing and storing the supercritical control parameters and not measuring, diagnosing and storing the subcritical control parameters during the production phase;

in which the machine comprises at least one main medium feed line which splits up into a plurality of branch medium feed lines, in which a main sensor is provided for measuring a control parameter at the main medium feed line and branch sensors are provided for measuring a similar type of control parameter at their corresponding branch medium feed line, and wherein the control parameter to be measured by the main sensor has been classified as being one of the supercritical control parameter and the control parameters to be measured by the branch sensors have been classified as being one of the subcritical control parameters, wherein, during the pre-production phase, the pre-production test procedure further comprises the step of measuring, diagnosing and storing the control parameters in at least the branch medium feed lines, and wherein, during the production phase, the method further comprises the step of measuring, diagnosing and storing the control parameter in the main medium feed line and not measuring, diagnosing and storing the control parameters in the branch medium feed lines.

7. Method according to claim 6, in which the stations of the machine comprise a plurality of holder positions for sterilizing, filling and/or closing a plurality of holders at the respective stations at the same time, in which the main medium feed line is connected to a medium supply, and in which, during the production phase, medium is distributed over the plurality of holder positions at the same time via distribution nozzles at the ends of the branch medium feed lines, wherein, during the pre-production phase, the pre-production test procedure further comprises the step of measuring, diagnosing and storing a flow of the medium in at least the branch medium feed lines, and wherein, during the production phase, the method further comprises the step of measuring, diagnosing and storing a flow of the medium in the main medium feed line and not measuring, diagnosing and storing the flow of sterilization medium in the individual branch medium feed lines.

8. Method according to claim 7, in which the main medium feed line is connected to a sterilization medium supply, and in which, during the production phase, sterilization medium is distributed over the plurality of holder positions at the same time via distribution nozzles at the ends of the branch medium feed lines, wherein, during the pre-production phase, the pre-production test procedure further comprises the step of measuring, diagnosing and storing a flow of the sterilization medium in at least the branch medium feed lines, and wherein, during the production phase, the method further comprises the step of measuring, diagnosing and storing a flow of the sterilization medium in the main medium feed line and not measuring, diagnosing and storing the flow of sterilization medium in the individual branch medium feed lines.

9. Method according to claim 7, in which the main medium feed line is connected to a drying gas supply, and in which, during the production phase, drying gas is distributed over the plurality of holder positions at the same time via distribution nozzles at the ends of the branch medium feed lines, wherein, during the pre-production phase, the pre-production test procedure further comprises the step of measuring, diagnosing and storing a flow of the drying gas in at least the branch medium feed lines, and wherein, during the production phase, the method further comprises the step of measuring, diagnosing and storing a flow of the drying gas in the main medium feed line and not measuring, diagnosing and storing the flow of drying gas in the individual branch medium feed lines.

10. Method according to claim 7, in which the main medium feed line is connected to a purge medium supply, and in which, during the production phase, purge medium is distributed over the plurality of holder positions at the same time via distribution nozzles at the ends of the branch medium feed lines, wherein, during the pre-production phase, the pre-production test procedure further comprises the step of measuring, diagnosing and storing a flow of the purge medium in at least the branch medium feed lines, and wherein, during the production phase, the method further comprises the step of measuring, diagnosing and storing a flow of the purge medium in the main medium feed line is measured, diagnosed and stored and not measuring, diagnosing and storing the flow of purge medium in the individual branch medium feed lines.

11. Method of operation of an aseptic product filling machine, the operation comprising:

a pre-production phase in which sterilization, filling and closing stations of the machine are sterilized, and a production phase in which a sterilization, filling and closing of a plurality of holders takes place at the respective stations, in which, during the operation, control parameters of the stations are monitored for remaining in a pre-defined range, in which the monitoring comprises a measuring of the control parameters by means of sensors, a diagnosing of the measured control parameters and a storing of the measured control parameters, and in which the control parameters have been classified into a category of supercritical and a category of subcritical control parameters, wherein the method further comprises the steps of:

performing a pre-production test procedure during the pre-production phase in which at least the subcritical control parameters are measured, diagnosed and stored;

checking if the subcritical control parameters are within their range;

starting the production phase if all of the subcritical control parameters are indeed within their range; and measuring, diagnosing and storing the supercritical control parameters and not measuring, diagnosing and storing the subcritical control parameters during the production phase, wherein a number of subsequent pre-production and production phases are performed after each other, wherein sterilized, filled and closed holders of a particular production phase are only released for distribution after the pre-production test procedure which is performed after this particular production phase has a positive outcome.

* * * * *